US009695014B2

(12) United States Patent
Begle

(10) Patent No.: US 9,695,014 B2
(45) Date of Patent: Jul. 4, 2017

(54) ELEVATOR HAVING A SUSPENSION

(71) Applicant: Inventio AG, Hergiswil (CH)

(72) Inventor: Guntram Begle, Kussnacht a/Rigi (CH)

(73) Assignee: Inventio AG, Hergiswil (CH)

( * ) Notice: Subject to any disclaimer, the term of this patent is extended or adjusted under 35 U.S.C. 154(b) by 222 days.

(21) Appl. No.: 14/327,830

(22) Filed: Jul. 10, 2014

(65) Prior Publication Data

US 2014/0332321 A1 Nov. 13, 2014

Related U.S. Application Data

(63) Continuation of application No. 12/738,744, filed as application No. PCT/EP2008/063840 on Oct. 15, 2008, now abandoned.

(30) Foreign Application Priority Data

Oct. 17, 2007 (EP) ..... 07118710

(51) Int. Cl.
*B66B 11/08* (2006.01)
*B66B 7/06* (2006.01)
(Continued)

(52) U.S. Cl.
CPC ..... *B66B 11/08* (2013.01); *B66B 7/062* (2013.01); *B66B 15/04* (2013.01); *D07B 1/162* (2013.01); *D07B 5/005* (2013.01); *D07B 5/006* (2015.07); *D07B 1/0673* (2013.01); *D07B 1/16* (2013.01); *D07B 1/22* (2013.01); *D07B 2201/1008* (2013.01); *D07B 2201/2086* (2013.01); *D07B 2201/2087* (2013.01); *D07B 2401/2015* (2013.01); *D07B 2501/2007* (2013.01)

(58) Field of Classification Search
CPC ..... B66B 11/08; B66B 7/062; B66B 15/04; D07B 5/006; D07B 5/005; D07B 1/162
USPC ..... 187/250, 251, 254
See application file for complete search history.

(56) References Cited

U.S. PATENT DOCUMENTS 3,049,460 A 8/1962 Garbin et al.
3,851,535 A 12/1974 Presentey
(Continued)

FOREIGN PATENT DOCUMENTS

CN 1585721 A 2/2005
GB 2134209 A 8/1984
(Continued)

*Primary Examiner* — Michael Riegelman
(74) *Attorney, Agent, or Firm* — Shumaker Loop & Kendrick; William J. Clemens

(57) ABSTRACT

An elevator includes a car, a counterweight, a suspension working together with the car and the counterweight, and a wheel at least partially wound around by the suspension. The suspension includes a tie beam arrangement with two tie beams and an encasing shell wherein a ratio of the width of the suspension to the height thereof is in a range between one and three. The wheel includes a flute having a flat base for guiding the suspension. When the suspension is unloaded, there is an air gap between the suspension and a guide region of the flute. The suspension is ovalized under loading to close the air gap. The shell is coated, at least in areas, on the outer surface thereof, wherein the coating optionally has a friction-reducing, friction-increasing, and/or wear-detecting effect.

20 Claims, 4 Drawing Sheets

(51) Int. Cl.

| | |
|---|---|
| ***B66B 15/04*** | (2006.01) |
| ***D07B 5/00*** | (2006.01) |
| *D07B 1/06* | (2006.01) |
| *D07B 1/16* | (2006.01) |
| *D07B 1/22* | (2006.01) |

(56) References Cited

U.S. PATENT DOCUMENTS

| | | | | |
|---|---|---|---|---|
| 3,948,113 | A | | 4/1976 | Stork |
| 4,227,041 | A | * | 10/1980 | Den ..... H01B 7/0823 174/113 R |
| 4,265,627 | A | | 5/1981 | Imamura |
| 4,773,896 | A | | 9/1988 | Bouteiller et al. |
| 5,026,444 | A | | 6/1991 | Hollaway, Jr. |
| 5,605,036 | A | | 2/1997 | Onuma et al. |
| 6,364,063 | B1 | | 4/2002 | Aulanko et al. |
| 6,371,448 | B1 | | 4/2002 | De Angelis |
| 6,386,324 | B1 | | 5/2002 | Baranda et al. |
| 6,390,242 | B1 | | 5/2002 | Baranda et al. |
| 6,419,208 | B1 | | 7/2002 | Baranda et al. |
| 6,488,123 | B2 | | 12/2002 | Pitts et al. |
| 6,508,051 | B1 | | 1/2003 | De Angelis |
| 6,672,046 | B1 | | 1/2004 | Prewo et al. |
| 6,739,433 | B1 | | 5/2004 | Baranda et al. |
| 6,742,769 | B2 | | 6/2004 | Baranda et al. |
| 2002/0108814 | A1 | | 8/2002 | Pitts et al. |
| 2007/0034454 | A1 | | 2/2007 | Dold et al. |
| 2007/0062762 | A1 | | 3/2007 | Ach |
| 2008/0087500 | A1 | | 4/2008 | Ach et al. |
| 2010/0236869 | A1 | | 9/2010 | Fargo et al. |
| 2010/0243378 | A1 | | 9/2010 | Begle |
| 2012/0103730 | A1 | | 5/2012 | Hoerler |

FOREIGN PATENT DOCUMENTS

| | | | |
|---|---|---|---|
| GB | 2162283 | A | 1/1986 |
| JP | 4920811 | | 5/1974 |
| JP | H0921084 | A | 1/1997 |
| JP | H1029777 | A | 2/1998 |
| WO | 9829326 | | 7/1998 |
| WO | 9943885 | | 9/1999 |
| WO | 0059819 | | 10/2000 |
| WO | 03043927 | A2 | 5/2003 |
| WO | 2005054569 | A2 | 6/2005 |

* cited by examiner

ELEVATOR HAVING A SUSPENSION

CROSS-REFERENCE TO RELATED APPLICATIONS

This application is a continuation of the co-pending U.S. patent application Ser. No. 12/738,744 filed May 20, 2010.

FIELD OF THE INVENTION

The present invention relates to an elevator having a car and a counterweight coupled by a suspension including a tie beam arrangement.

BACKGROUND OF THE INVENTION

An elevator conventionally comprises a car which can move in a shaft and can be coupled via a suspension to a counterweight moving in the opposite direction to the car in order to reduce the lifting work to be applied. The suspension can in this case at least partially loop around one or more drive wheels to which a drive of the elevator applies a torque in order to hold or to move the car. The counterweight can in the process ensure the driving capacity of drive wheels of this type. In order to reduce the torque to be applied by the drive, the suspension can loop around pulley block-like deflection wheels which are fastened to the car, the counterweight or in an inertially secure manner in the shaft. The drive and deflection wheels will be referred to hereinafter jointly as wheels.

In addition to steel cables, flat belts are also known, for example from WO 99/43885 and JP 49-20811 A, as suspensions for elevators in which four, five or six tie beams are arranged next to one another in a shell encasing the tie beams. These flat belts have a longitudinal structure in the form of a plurality of grooves which are formed between adjacent tie beams and run in the longitudinal direction of the suspension. In this connection, WO 99/43885 also proposes a drive wheel with a flute in which the flat belt is received and the flute base of which has an outer contour which is complementary to the longitudinal profile of the flat belt and has projections which engage with the longitudinal grooves and in this way additionally guide the flat belt in the axial direction.

On account of the at least four tie beams arranged next to one another and a shell encasing the tie beams with a substantially uniform wall thickness, the known flat belts have a width/height ratio, i.e. a quotient of the axial line through the radial extension of the flat belt looping around a wheel that is much greater than 1. In this regard, WO 99/43885 specifies values of 2, preferably 5, as preferred lower limits of the width/height ratio.

Flat belts of this type have the advantage over conventional steel cables of allowing smaller radii of deflection.

However, high transverse forces occur in wide suspensions of this type, which have a high geometrical moment of inertia in the direction of their width, in particular as a result of skew on the wheels looped around by flat belts of this type, but for example also in the event of twisting of flat belts of this type about their longitudinal axis in order to loop around successive wheels in opposite directions with the same side. The transverse forces can lead to premature wear of the suspension or the wheel. In addition, the installation of suspensions of this type, which are rigid in the width direction, is hampered.

If the flute base is, as proposed in WO 99/43885, contoured, this impedes a compensation of internal pressure, which is desired in particular in the event of a displacement or turning of the belt, within the suspension; this also leads to premature wear. In addition, installation is hampered still further on account of the necessary orientation of the flute structure and suspension longitudinal structure relative to each other.

SUMMARY OF THE INVENTION

An object of the present invention is therefore to reduce the wear of the suspension and to increase the ease of installation.

A suspension according to the present invention comprises a tie beam arrangement and a shell which encases the tie beam arrangement and the outer surface of which has a longitudinal structure at least in the region provided for looping around a wheel of the elevator.

The tie beam arrangement consists in this case of just two tie beams. This allows the suspension to be formed with a width/height ratio which is greater than 1 and at the same time less than or equal to 3. The lower limit of 1 ensures that the suspension is overall flat and allows, compared to known cables having a circular cross section, i.e. a width/height ratio equal to 1, smaller radii of deflection and thus smaller wheels. At the same time, the upper limit of 3 ensures that the transverse forces occurring in the suspension do not become too great and in this way prevents excessive wear. At the same time, a suspension, the width/height ratio of which is, on account of the two tie beams, in the proposed range, is sufficiently flexible in the width direction, thus increasing the ease of installation.

The tie beams can be made of carbon, aramid or other plastics materials having sufficiently high tensile strength. However, they are preferably made from metallic wires, in particular steel wires which are particularly beneficial with respect to manufacturability or deformability, strength and service life. The wires may be singly or multiply stranded to form cables, wherein a cable can be stranded from a plurality of braids which are, for their part, made from stranded wires. A core, in particular a textile or plastics material core, can be arranged in the braids. However, the intermediate spaces between the wires or braids are preferably partially or completely filled by material of the shell encasing the tie beams.

In a preferred embodiment, the two tie beams are laid in opposite directions, i.e. the cable forming one tie beam is laid to the right and the cable forming the other tie beam of the tie beam arrangement is laid to the left. This cancels out tendencies of the two tie beams to become twisted in relation to each other and in this way counteract turning of the suspension.

Preferably, the tie beams or the steel cables forming the tie beams or the wires stranded to form the cables have a maximum dimension in the range between 1.25 mm (millimeters) and 4 mm, preferably in a range between 1.5 mm and 2.5 mm and in particular substantially equal to 1.5 mm. This has been found to be an optimum compromise between weight, strength and manufacturability. Tie beams of this type allow advantageously small radii of deflection, in particular, to be achieved. On use of suspensions of this type in elevators having high weights, steel cables having a diameter of up to 8 mm are preferably used.

The tie beams can for example have a substantially round cross section. In this case, the aforementioned maximum dimension corresponds to the diameter of the tie beam. A suspension of this type can be manufactured particularly easily, as no attention has to be paid to the orientation with respect to the longitudinal axis in the arrangement of the tie beams in the shell. Equally, the tie beams can also have oval or rectangular cross sections which are particularly suitable for implementing the width/height ratio between 1 and 3.

An alternative embodiment provides for the two tie beams to touch each other at least at certain points. This allows particularly compact suspensions to be manufactured.

Preferably, the longitudinal structure of the outer surface of the suspension has at least one groove running in the longitudinal direction of the suspension. This advantageously increases the flexibility of the suspension without significantly reducing its tensile strength. A groove is in this case preferably provided in the region of the outer surface with which the suspension loops around a wheel of the elevator.

A groove of this type can for example be generated in that the outer surface of the suspension follows substantially an outer contour of the two tie beams arranged next to each other. As a result, both tie beams are advantageously encased substantially at each point with the same wall thickness, so that tensions are distributed homogeneously within the suspension. At the same time, an above-described advantageous groove between the two tie members is produced in a simple manner on each of the mutually opposing wide sides of the suspension. Furthermore, an outer surface or sheathing of this type can be designed using little sheathing material; this has a cost-beneficial effect.

The groove or a channel can also be arranged just below the outer surface of the suspension; on the one hand, this allows transverse contraction, especially in set-apart tie beams, while the compression of the suspension is concentrated in the region of the tie beam and a central region of the suspension is not compressed. The central region, corresponding to the non-compressed region of the suspension and the flute, is in this case advantageously about 20% to 50% of the width of the suspension.

The shell can enclose the two tie beams, in each case in a trapezoidal manner. This advantageously produces inclined outer flanks of the suspension that advantageously increase, on account of the wedging effect, the contact pressure and thus the driving capacity of a drive wheel while the initial tension remains the same.

Preferably, the suspension is embodied symmetrically with respect to its transverse axis running in the width direction, i.e. an axial direction of a wheel looped around by the suspension. This facilitates installation, as the suspension can also be applied turned through 180°, and advantageously allows looping in opposite directions of successive wheels having identical outer surface contours.

An elastomer in particular, for example polyurethane (PU) or ethylene propylene diene monomer (EPDM) rubber, which is advantageous with respect to damping and frictional properties and also wear behavior, has proven to be a suitable shell material.

The outer surface can be influenced in a targeted manner; for this purpose, different regions of the suspension can be provided with coatings or else with different coatings. Thus, one region can be provided with a coating for achieving a good sliding property. This region may for example be a region remote from the traction region or it may be a lateral region of the suspension. One region, in particular the traction region of the suspension, is advantageously provided with a coating for achieving good traction or force transmission. One region can also be provided with a colored coating. This is advantageous, as this allows the suspension to be easily installed or applied, as any accidental turning can easily be detected and corrected. It goes without saying that the sheathing can also be constructed in a plurality of layers. In this way, a state of wear or abrasion may easily be detected when differently colored layers are used. A coating of this type can for example be sprayed on, adhesively bonded on, extruded on or flocked on and be made of plastics material and/or woven fabric.

An elevator comprises a car and a counterweight coupled thereto via a suspension. The suspension interacts with the car and the counterweight in order to hold or to lift the car and the counterweight and can for this purpose be fastened to the car and/or the counterweight in each case directly, for example via a wedge lock, or loop around one or more wheels connected to the car or the counterweight.

The elevator has a tie beam arrangement and a shell which encases the tie beam arrangement and has a longitudinal structure in a region of the outer surface that loops around a wheel of the elevator, the wheel having a flute for laterally guiding the suspension, in which the suspension is at least partially received. The suspension loops around the wheel at least partially, for example by substantially 180°.

The flute base of the flute, on which the suspension rests with one wide side and which is looped around by the suspension, is embodied so as to be substantially constantly planar or flat. This simplifies the manufacture of a wheel of this type. The ease of installation of the elevator is also increased, as the longitudinal structure of the suspension no longer has to be aligned with a structure of the flute base that is complementary thereto. However, in particular, the planar flute base allows slight internal deformations within the suspension, so that a tension in the suspension can be distributed more uniformly over the cross section thereof. In this case, the flute, as a lateral stop, ensures sufficient lateral guidance of the suspension without impeding microdeformations of this type. Advantageously, the flute follows, at the edges on both sides of the suspension, roughly the shape of the suspension, that is to say the flute has an inlet region on which there is generally no contact with the suspension via the looping region; the inlet region merges with a guide region which is in contact with the suspension via the looping region. This means that the flute can follow, at its lateral boundaries corresponding to the wide side of the belt, the structure of the suspension, but that the flute base extending between these lateral boundaries is planar, that is to say it does not display any intermediate elevations.

The wheel, which is looped around by the suspension and receives the suspension in its flute having a flat flute base, can equally be a deflection or drive wheel. It is also possible for a plurality of, preferably all, the wheels of the elevator that are looped around by the suspension to be provided with flutes in which the suspension is in each case at least partially received and which have a planar or flat flute base. In an advantageous embodiment, the wheel is designed in such a way that a plurality of flutes having a flat flute base is arranged next to one another. This allows a plurality of similar suspensions to be guided, deflected and/or driven next to one another.

One or more drive wheels can in this case be coupled to a drive of the elevator, of which the torques applied to the wheel are introduced into the suspension with frictional engagement as longitudinal forces. A drive of this type can comprise one or more asynchronous motors and/or permanent magnet motors. This embodiment allows drives having small dimensions, so that the space required overall for the elevator can be reduced in a building. For this purpose, the elevator can in particular be embodied without a machine room.

A suspension, such as has been described hereinbefore, is particularly advantageously used in an elevator. The advantages described in this regard, in particular with respect to lower wear and greater ease of installation, are accordingly obtained.

The wheel, in particular the drive wheel, is advantageously made of steel or casting material (GG, GGG). Preferably, the flutes of the drive wheel are formed directly in a spindle which is directly, preferably integrally, connected to a motor. In a preferred embodiment, the flute base has in this case in the circumferential direction an average roughness in a range between 0.1 μm (micrometers) and 0.7 μm, in particular between 0.2 μm and 0.6 μm and particularly preferably between 0.3 μm and 0.5 μm. In the axial direction, the flute base preferably has an average roughness in a range between 0.3 μm and 1.3 μm, in particular between 0.4 μm and 1.2 μm and particularly preferably between 0.5 μm and 1.1 μm. These roughnesses allow a coefficient of friction which imparts an adequate driving capacity to be set in the circumferential direction, whereas the suspension is guided with frictional engagement in the axial direction and excess wear to the flute flanks is in this way prevented. In order to achieve a desired surface property, the wheel can also be coated. Alternatively, the wheel, in particular a deflection wheel without a driving function, can be made of plastics material in which the required flutes are formed or directly shaped.

DESCRIPTION OF THE DRAWINGS

Further advantages and features of the present invention emerge from the exemplary embodiments. In the drawings, some of which are schematized.

DESCRIPTION OF THE PREFERRED EMBODIMENT

Figure 1:
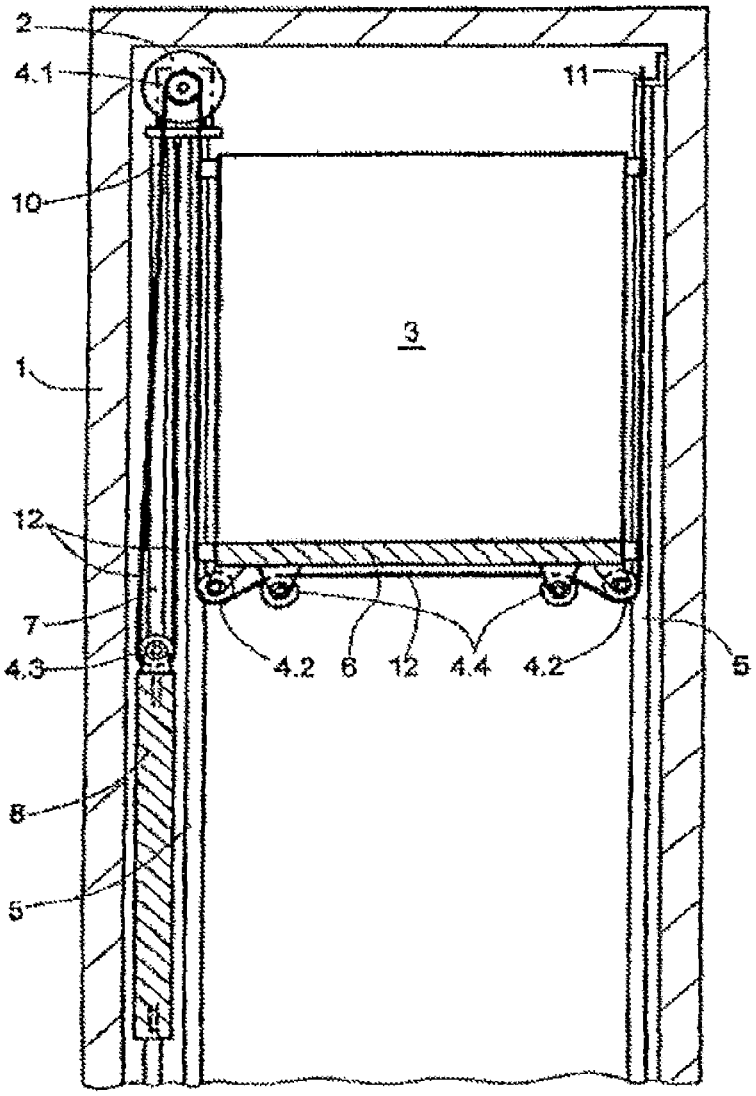
FIG. 1 is a lateral cross section of an elevator according to one embodiment of the present invention.

Mutually corresponding components or features are denoted in the figures by identical reference numerals.

FIG. 1 shows schematically an elevator according to one embodiment of the present invention. The elevator comprises a car 3 which can move along rails 5 in a shaft 1 and a counterweight 8 which is coupled to the car, moves in the opposite direction and is guided on a rail 7. A suspension 12, which will be described hereinafter in greater detail, is inertially fastened at one end at a first hang-up point 10 in the shaft 1. Starting from there, it loops around a deflection wheel 4.3, which is connected to the counterweight 8, through 180° and subsequently a drive wheel 4.1, also through 180°. Starting from there, it loops, after twisting through 180° about its longitudinal axis, around two deflection wheels 4.2, which are integrated into the floor 6 of the car 3, in the same direction, in each case through 90°, and is fastened at its other end at a second hang-up point 11 in the shaft 1. Between the two deflection wheels 4.2 connected to the car 3, two further deflection wheels 4.4, which each loop around the suspension 12 by about 12°, tension the suspension against the car floor 6 and in this way improve guidance thereof in the deflection wheels 4.2. The drive wheel 4.1 of the elevator without a machine room is in this case driven by an asynchronous motor 2 arranged in the shaft 1 in order to hold or to lift the car 3 and the counterweight 8.

Figure 2:
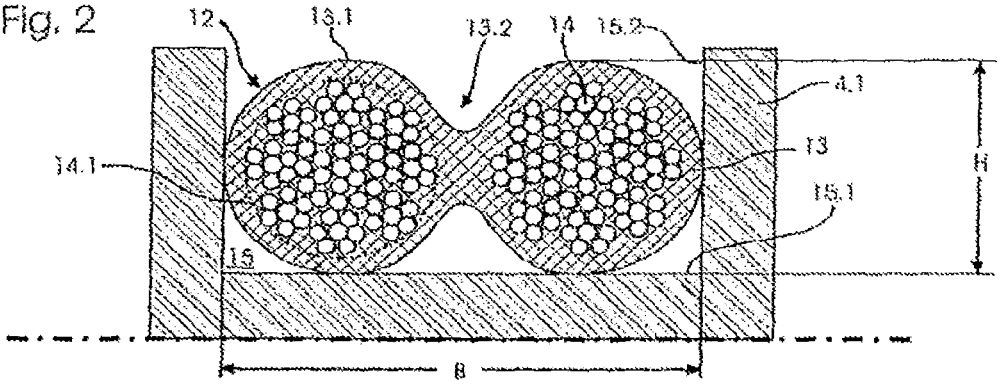
FIG. 2 shows a suspension with a suspension pick-up according to one embodiment of the present invention.

FIG. 2 is a cross section of the upper half of the drive wheel 4.1 of the elevator from FIG. 1 and the suspension 12 looping around the drive wheel.

The suspension 12 has two lateral tie beams 14, i.e. tie beams arranged axially next to each other with respect to the drive wheel, which each consist of nine interstranded braids. The core strand is in this case produced in three layers from nineteen interstranded steel wires and surrounded by eight two-layered outer braids each stranded from seven steel wires. The two tie beams 14 are laid in opposite directions. For this purpose, the outer braids of one tie beam are laid around the respective core braid to the right, those of the other to the left. This counteracts turning of the suspension 12.

The tie beams 14 have in this case a diameter of about 2.5 mm. This allows advantageously much smaller radii of deflection, and thus smaller drive and deflection wheels, to be achieved while maintaining an advantageous diameter ratio of $D/d \geq 40$, for example, wherein D denotes the diameter of the drive wheel and d denotes the diameter of a steel cable; this advantageously reduces the overall space required by the elevator. It goes without saying that even smaller diameter ratios can be achieved using high-strength tie beams.

The two tie beams 14 are embedded in a shell 13 made of EPDM. The shell has an outer surface 13.1 following substantially the outer contour 14.1, indicated by dashed lines in FIG. 2, of the two tie beams 14. As these tie beams arranged next to each other each have a substantially circular outer contour 14.1, the outer surface 13.1 has in cross section substantially the shape of a horizontal hourglass, a groove 13.2 being formed on the two wide sides (top, bottom in FIGS. 2, 3) in the longitudinal direction of the suspension 12.

As a result, the wall thickness of the shell 13 surrounding the tie beams 14 is advantageously the same substantially everywhere, leading to an improved distribution of tension in the suspension 12. At the same time, the grooves 13.2 facilitate a slight internal movement of the tie beams 14 in the shell 13 in relation to one another, so that transverse forces in the tie beam 12 can be reduced. However, it may also be desired for the tie beams 12 to be securely embedded in the shell 13. Accordingly, a shell material or a production method is selected allowing the shell material to be effectively bound into the tie beam.

On account of its construction, the tie beam 12 has a ratio of its width B in the axial direction of the drive wheel 4.1 to its height H in the radial direction of the drive wheel 4.1 of two. Equally, this ensures small radii of deflection and nevertheless sufficient flexibility of the suspension, in particular in its width direction. This increases in particular also the ease of installation of the more flexible suspension 12 which can be applied to the wheels 4.1 to 4.4 more easily. In order to increase the ease of installation still further, the suspension is embodied symmetrically with respect to its transverse or vertical axis which is positioned perpendicularly to its longitudinal direction and runs in the width or vertical direction, so that it can also be applied turned through 180° and can loop around successive wheels in opposite directions with identical outer surface contours.

The suspension 12 is received in a flute 15 of the drive wheel 4.1 in such a way that it is in the example positioned almost completely within the flute 15, touches the two lateral flanks or the inlet region 15.2 (left, right in FIG. 2) of the flute 15 and rests on the flute base 15.1 of the flute. The flute base 15.1, which is looped around by the suspension 12 in this way, is embodied in a planar or flat manner. This facilitates the above-described internal movement of the suspension 12, so that transverse forces in the suspension 12, and thus wear of the suspension 12 and the drive wheel 4.1, are reduced.

The deflection wheels 4.2 to 4.4 have precisely such flutes which have a planar flute base (not shown) and in which the suspension 12, which loops around the deflection wheels 4.2 to 4.4, is received in each case in the same manner as was described for the drive wheel 4.1 with reference to FIG. 2.

Figure 3:
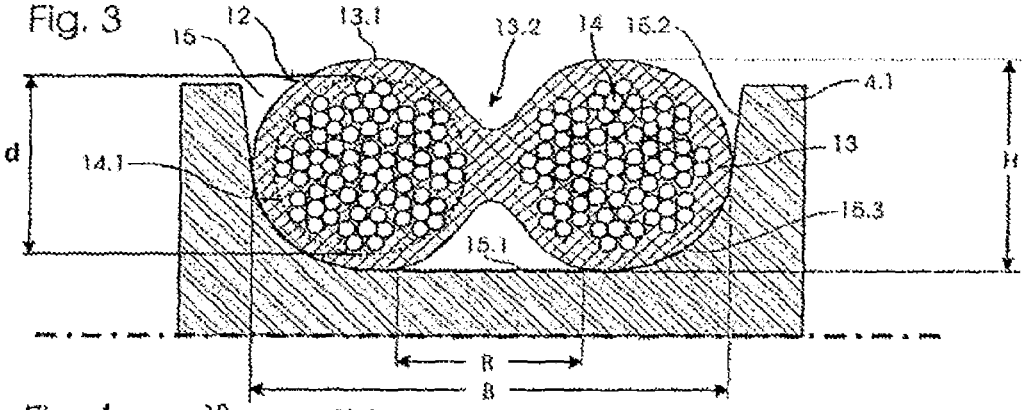
FIG. 3 shows a suspension with a suspension pick-up according to a further embodiment of the present invention.
Figure 4:
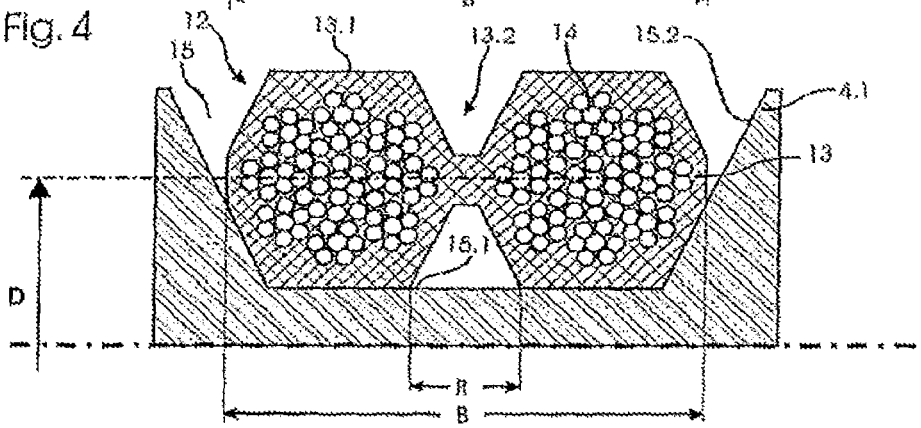
FIG. 4 shows another suspension with a suspension pick-up according to a further embodiment of the present invention.

FIG. 3 shows a suspension 12 such as is already known from FIG. 2. In this example, the suspension 12 is, again, received in a flute 15 of the drive wheel 4.1. The flute 15 contains the flute base 15.1, a lateral guide region 15.3 and a lateral inlet region 15.2. The flute base is designed in a flat or planar manner. The flute 15 follows roughly the shape of the suspension 12 at the edges of the suspension on both sides. The inlet region 15.2 is not in contact with the suspension via the looping region. The inlet region 15.2 merges with the guide region 15.3 which is in contact with the suspension 12 via the looping region. This means that the flute follows, at its lateral boundaries corresponding to the wide side of the suspension 12, the structure of the suspension; the flute base 15.1 extending between these lateral boundaries is planar; it does not display any intermediate elevations. In FIG. 2 and FIG. 4, which will be described hereinafter, the guide region 15.3 is in practice dispensed with, as the insertion region 15.2 and the flute base 15.1 strike each other substantially directly. If the flute 15 of a drive wheel is provided with surfaces influencing the coefficient of friction, for example, the insertion region 15.2 is advantageously designed so as to reduce the coefficient of friction and the flute base 15.1 is designed so as to increase the coefficient of friction, the guide region 15.3 is embodied as a transition. The part positioned close to the insertion region 15.2 is designed so as to reduce the coefficient of friction and the part positioned close to the flute base 15.1 is designed so as to increase the coefficient of friction; this allows safe transmission of traction from the flute to the suspension and at the same time the lateral guidance is designed so as to be as friction-free as possible.

Now, FIG. 4 shows a modification of the drive wheel 4.1 of the elevator which is shown in FIG. 1 and is looped around by a suspension 12 according to a further embodiment of the present invention. Only the differences from the embodiment according to FIGS. 1 to 3 will be examined hereinafter.

The shell 13 of the suspension 12 according to the further embodiment of the present invention as shown in FIG. 4 is embodied in a trapezoidal manner. In particular, the shell regions, which each surround a tie beam 14, have a trapezoidal cross section on mutually opposing wide sides (top, bottom in FIG. 4) of the suspension 12. Thus, both the two grooves 13.2 formed between the tie beams 14 and the adjoining regions of the outer surface 13.1 of the suspension 12 have a trapezoidal cross section on both wide sides. The mutually opposing narrow sides (left, right in FIG. 4) of the suspension 12 are thus likewise embodied in a trapezoidal manner and are at an angle in relation to the radial direction of the drive wheel 4.1.

The flanks 15.2, which oppose one another in the axial direction, of the flute 15 formed in the drive wheel 4.1 are inclined by the same angle in relation to the radial direction, so that the suspension 12, which is received in the flute 15 having a trapezoidal cross section, rests on these flanks 15.2 with its outer oblique faces facing the drive wheel 4.1. As a result of the wedging effect thereby caused, the driving capacity is advantageously increased while the initial tension remains the same.

As indicated in the figures, the suspension does not have to be completely received in the flute 15 in the radial direction, but can protrude radially outward beyond the flute. However, in a modification (not shown), the suspension 12 is completely received in the flute 15 in order to protect it from damage.

Figure 5:
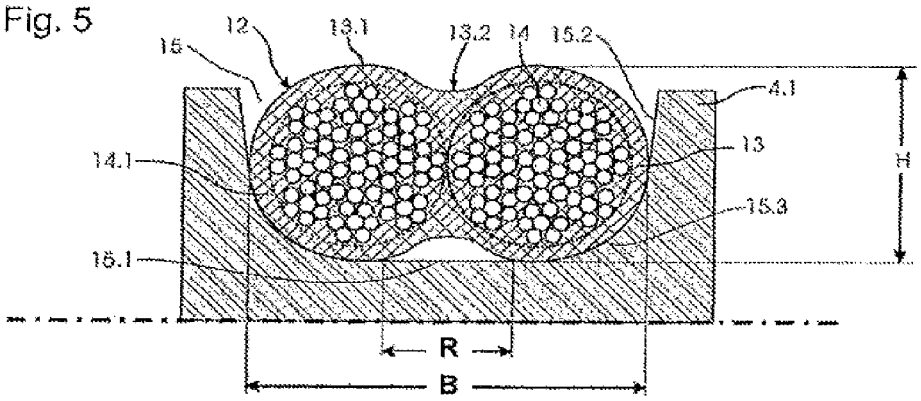
FIG. 5 shows an alternative suspension with a suspension pick-up according to a further embodiment of the present invention.

FIG. 5 shows an alternative embodiment of the suspension 12 based on the embodiment according to FIG. 3. According to this embodiment, the two tie beams 14 touch each other at least at certain points. An outer contour of the individual tie beam 14 is naturally structured, as the tie beam 14 is composed of individual wires. The two tie beams 14 are now pushed together only to the extent that the outermost wires touch one another. The groove 13.2 or a depression is located in the shell region between the two tie beams. The flute base 15.1 of the flute 15 of the drive wheel 4.1 is planar. Via a region R of the flute base, compression between the flute base 15.1 and shell 13 is accordingly low. The illustrated suspension has the width B and the proportion (R/B) of the compression-free region R is about 30% in the illustrated example.

Figure 6:
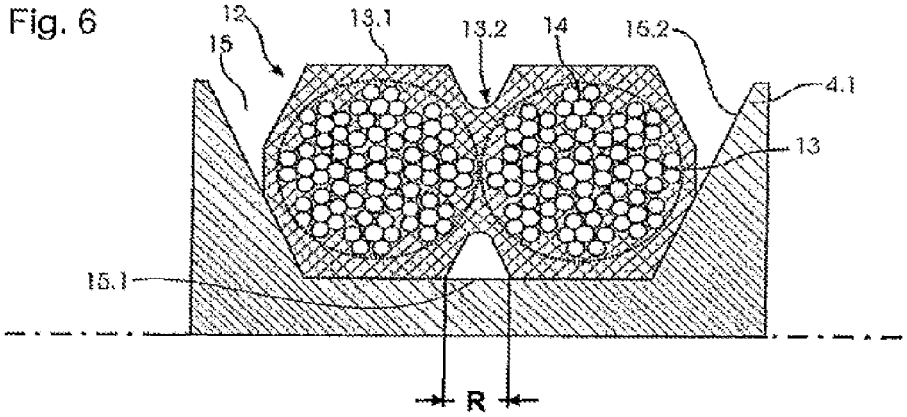
FIG. 6 shows another suspension with a suspension pick-up according to a further embodiment of the present invention.

Now, FIG. 6 shows a combination of the embodiments according to FIG. 4 and the tie beam arrangement according to FIG. 5. The groove 13.2 allows the shell material 13 to be adapted slightly in accordance with an effective flute width and shape. Minor deviations are obtained as a result of manufacturing tolerances of the parts involved such as the drive wheel 4.1 and suspension 12. This not only becomes valid as a result of the embodiment according to FIG. 6; it applies to all the illustrated embodiments.

Figure 7:
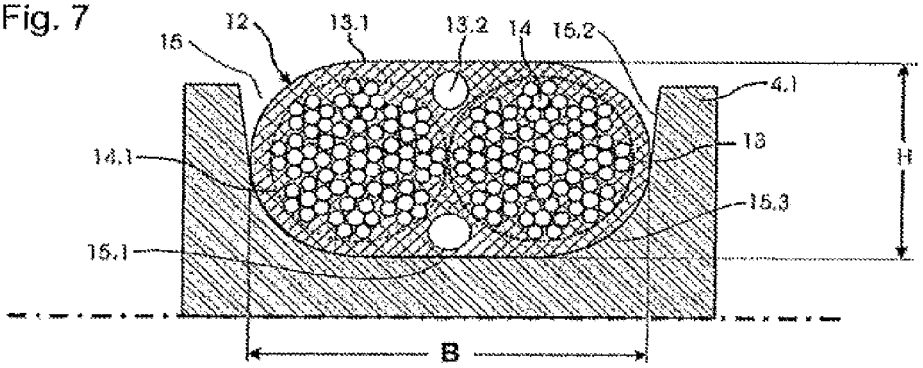
FIG. 7 shows a further alternative suspension with a suspension pick-up.

FIG. 7 shows a further embodiment of the suspension 12 which is received in a flute 15 having a planar flute base 15.1. In this embodiment of the suspension 12, the groove 13.2 or a channel is arranged just below the outer surface 13.1 of the suspension 12. This also allows a transverse contraction, while the compression of the suspension is concentrated in the region of the tie beams 14 and a central region R of the suspension 12 remains uncompressed.

Figure 8:
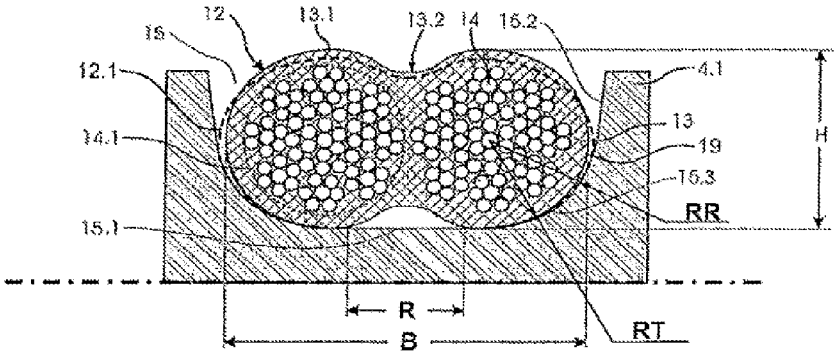
FIG. 8 shows an alternative embodiment of a flute with a suspension.

FIG. 8 shows a further embodiment of the flute 15 having a planar flute base 15.1 for receiving the suspension 12. The guide region 15.3 is widened in the direction of the inlet region 15.2 in such a way that an air gap 19 is left between the guide region 15.3 and the unloaded suspension 12. This is advantageously achieved in that a guide region radius RR of the guide region 15.3 is larger than a suspension radius RT of the unloaded suspension 12. The suspension 12 is deformed under loading. The shape produced under loading is obtained as a result of a tensile stress, which is produced by way of example by a car load hanging from the suspension, and a flexural stress which results from the suspension being placed around the drive wheel 4.1. Now, the widening of the guide region 15.3 enables the suspension to assume a natural shape freely, without restrictive transverse movements, under loading.

Advantageously, the guide region radius RR or the widened guide region 15.3 is designed in such a way that the suspension 12 can ovalize, in the event of a deflection via the drive wheel 4.1 under a loading force which is normally to be expected, in such a way that it is substantially adapted to the guide region radius RR or the widened guide region 15.3. The loading force which is normally to be expected generally corresponds to a normal operating state of the elevator installation. This enables the suspension 12 in the loaded state, when it runs around the drive wheel 4.1 under force, to be ovalized or obtained such as is illustrated in FIG. 8 by dashed line 12.1. As a result, the suspension 12 is not impeded in the transverse contraction; this reduces lateral wear while the suspension is centered in the flute 15 as a result of the shape of the guide region.

Figure 9:
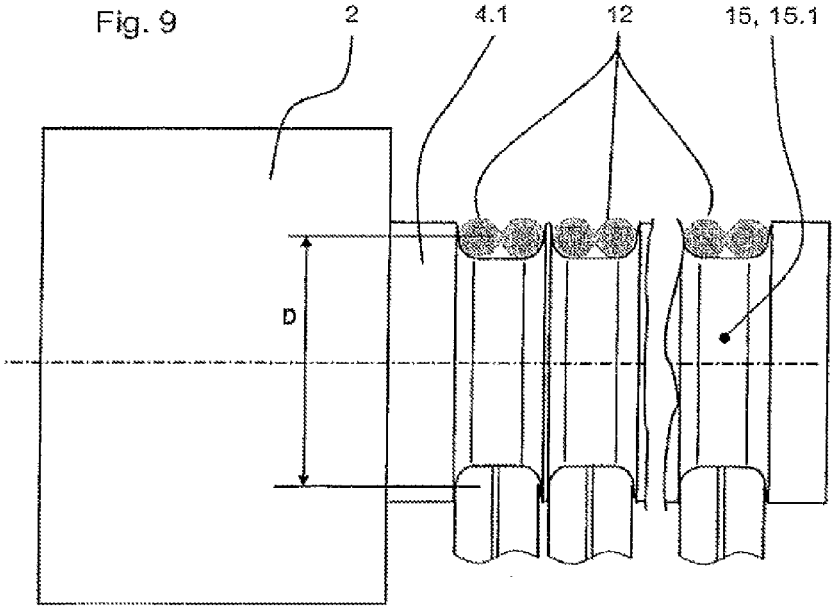
FIG. 9 shows an arrangement of a suspension with a drive wheel according to one embodiment of the present invention.

FIG. 9 shows schematically a drive such as could be used in an elevator according to FIG. 1. A motor 2 drives a drive wheel 4.1 which in the illustrated example is integrated directly into a spindle of the drive or the motor 2. The drive wheel 4.1 has a plurality of flutes 15, a suspension 12 being placed in each of the flutes 15. The flute base 15.1 is planar and it merges with the lateral insertion regions 15.2 by means of the radius. The radius corresponds roughly to an outer shape of the suspension in this region. The number of flutes or suspensions required is determined by a carrying force of the suspension and the weight of the car or counterweight.

The foregoing explanations have been given predominantly in relation to a drive wheel 4.1. They apply analogously also to deflection rollers 4.2, 4.3, 4.4. It goes without saying that the embodiments shown are combinable. Thus, the suspensions 12 of the exemplary embodiments according to FIGS. 2 to 6 can of course also be provided with grooves 13.2 or a channel positioned just below the outer surface 13.1 of the suspension 12 and the outer contours of the suspension 12 can be varied by the person skilled in the art. The outer contour may in particular also be oval, ribbed or corrugated, or both symmetrical and unsymmetrical outer surfaces 13.1 or sheathings may be used. Furthermore, the ovalized flute shape according to FIG. 8 may also be applied to other outer contours.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator having a car, a counterweight, a suspension coupling the car and the counterweight, a wheel contacted and at least partially looped by the suspension, and at least one drive for driving the car, the counterweight and the suspension, the elevator being arranged with the car, the counterweight, the suspension and the drive in a common shaft, comprising:

the suspension having a cross section ratio of a width to a height being in a range of between one and three;

the suspension extending longitudinally with a tie beam arrangement and a shell which encases the tie beam arrangement and forms an outer surface that contacts the wheel;

the wheel having a flute in which the suspension is at least partially received, and a flute base of the flute, which is contacted by the suspension and is formed substantially planar, wherein said flute has a lateral guide region and a lateral inlet region, said guide region extending between said inlet region and said base, said guide region widening in a direction of said inlet region to form air gap between said guide region and a majority of a height of the suspension when unloaded, the suspension being widened under a loading force whereby the suspension is substantially adapted to said widened guide region closing said air gap, and wherein said guide region has a guide region radius larger than a suspension radius of the suspension when unloaded, the suspension being ovalized under the loading force whereby the suspension is substantially adapted to said guide region radius; and said shell is coated on at least a portion of said outer surface, said coating selectively having at least one of a friction-reducing, a friction-increasing and a wear-detecting effect when contacting the wheel.

2. The elevator according to claim 1 wherein said tie beam arrangement includes at least two tie beams touching one another at a point.

3. The elevator according to claim 2 wherein said at least two tie beams include metallic wires formed into singly or multiply stranded steel cables, said at least two tie beams being laid in opposite directions.

4. The elevator according to claim 1 wherein said tie beam arrangement includes tie beams having a diameter in a range between 1.25 mm and 8 mm.

5. The elevator according to claim 1 wherein said tie beam arrangement includes tie beams having a diameter in a range between 1.5 mm and 2.5 mm.

6. The elevator according to claim 1 wherein said outer surface of the suspension has at least one groove formed therein running in a longitudinal direction of the suspension.

7. The elevator according to claim 6 wherein said at least groove is positioned between two tie beams of the suspension.

8. The elevator according to claim 1 wherein said at least one drive includes one of an asynchronous motor and a permanent magnet motor.

9. The elevator according to claim 1 wherein said flute is partially coated.

10. The elevator according to claim 1 wherein said flute has a flute base with an average roughness in a range of between 0.1 pm and 0.7 pm in a circumferential direction.

11. The elevator according to claim 1 wherein said flute base has a surface with an average roughness in a range of between 0.2 pm and 0.6 pm in a circumferential direction.

12. The elevator according to claim 1 wherein said flute base has a surface with an average roughness in a range of between 0.3 pm and 0.5 pm in a circumferential direction.

13. The elevator according to claim 1 wherein said flute base has a surface with an average roughness in a range between 0.3 pm and 1.3 pm in an axial direction.

14. The elevator according to claim 1 wherein said flute base has a surface with an average roughness in a range between 0.4 pm and 1.2 in an axial direction.

15. The elevator according to claim 1 wherein said flute base has a surface with an average roughness in a range between 0.5 pm and 1.1 pm in an axial direction.

16. An elevator having a car, a counterweight, a suspension coupling the car and the counterweight, a wheel contacted by the suspension, and a drive for driving the car, the counterweight and the suspension, comprising:

the suspension having a tie beam arrangement and a shell which encases said tie beam arrangement, the suspension extending in a longitudinal direction with an outer surface contacting and partially looping around the wheel;

the wheel having a flute in which the suspension is at least partially received, and a flute base of said flute being formed substantially planar and contacted by the suspension, wherein said flute has a lateral guide region and a lateral inlet region, said guide region extending between said inlet region and said base, said guide region widening in a direction of said inlet region to form air gap between said guide region and a majority of a height of the suspension when unloaded, the suspension being widened under a loading force whereby the suspension is substantially adapted to said widened guide region closing said air gap, and wherein said guide region has a guide region radius larger than a suspension radius of the suspension when unloaded, the suspension being ovalized under the loading force whereby the suspension is substantially adapted to said guide region radius; and the structure suspension having adjacent said outer surface a groove running in the longitudinal direction of the suspension.

17. The elevator according to claim 16 wherein said tie beam arrangement includes two tie beams and said groove is positioned between said tie beams.

18. The elevator according to claim 17 wherein said tie beams touch one another at a point.

19. The elevator according to claim 17 wherein said groove faces said base to provide a compression-free region between the base and said shell.

20. The elevator according to claim 17 wherein each of said tie beams is formed with the suspension radius.

* * * * *